US005313668A

United States Patent [19]

Bogan et al.

[11] Patent Number: 5,313,668

[45] Date of Patent: May 24, 1994

[54] PROTECTIVE LINER FOR HAT

[76] Inventors: Jeffery F. Bogan, 108 Cherokee, Searcy, Ark. 72143; Joseph L. Berry, Rte. 1, Box 446, Ward, Ark. 72176

[21] Appl. No.: 36,963

[22] Filed: Mar. 25, 1993

[51] Int. Cl.[5] ..... A42C 5/02

[52] U.S. Cl. ..... 2/181.4; 2/209.13

[58] Field of Search ..... 2/181.4, 53, 56, 60, 2/63, 181, 185 R, 190, 199, DIG. 11; 604/385.1

[56] References Cited

U.S. PATENT DOCUMENTS 4,502,156 3/1985 Wishman ..... 2/181
4,941,210 7/1990 Konucik ..... 2/181.4
5,025,504 6/1991 Benston ..... 2/181.4

*Primary Examiner*—Clifford D. Crowder

*Assistant Examiner*—Diana L. Biefeld

*Attorney, Agent, or Firm*—Ray F. Cox, Jr.

[57] ABSTRACT

In accordance with the present invention, a liner for a hat, cap or similar head covering comprises a layer of moisture absorbent material which is backed by a layer of moisture impervious material. Further, adhesive means are provided for releasably securing the liner to the sweatband of the hat, cap or similar headgear. The bottom and side edges of the moisture absorbing layer are sealed to prevent the migration of moisture, oil, grease and other contaminants through these edges of the liner. The upper edge of the liner is left unsealed so that a wicking action encourages the transport of moisture from the body of the moisture absorbing layer to the top edge where it may be evaporated.

8 Claims, 2 Drawing Sheets

PROTECTIVE LINER FOR HAT

BACKGROUND OF THE INVENTION

This invention relates to protective liners for the inside sweatband area of helmets, hats, caps and similar headgear and more particularly to a protective liner which is disposable.

Hats, caps and similar headgear are commonly provided with sweatbands lining the lower inside portion of the headgear in order to prevent the head of the user from directly contacting the material of the hat or cap. Such sweatbands are rarely completely effective in preventing moisture from migrating into the material of the hat or cap itself. Such headgear, unless constructed of moisture impervious materials such as solid plastic as would be true of a protective helmet, are likely to become rapidly stained by sweat, oil, grease and dirt and thus rendered unattractive. A stained hat or cap may thus be discarded well before the end of its useful lifetime. It is, therefore, desirable to have additional means for protecting a hat or cap from the migration of moisture and other contaminants through the sweatband into the material of the hat or cap.

It is known in the prior art to provide a disposable liner to be placed on or behind the sweatband to provide an additional barrier to the migration of moisture and contaminants into the material of the hat or cap.

U.S. Pat. No. 5,025,504 issued to Benston, et al. on Jun. 25, 1991 for "Liner For A Helmet, Hat, Cap Or Other Head Covering" discloses a liner for head coverings having a body with a central section and tapered end sections. The body includes liquid absorbing material and is releasably secured to the head covering. The liners of Benston are formed with a core of fibers, including thermoplastic fibers, sandwiched between facing and backing sheets. The sections of the liner allow the liner to be cut in transverse segments to adjust its length.

U.S. Pat. No. 3,578,736 issued to Dootson on May 18, 1971 for "Hat And Sweatband Insert Therefor" discloses a sweatband insert having a moisture absorbent face portion and a moisture impervious back portion with an upstanding central member. The central member provides a grasping portion for easy insertion of the insert behind the sweatband and also exposes a portion of the liner to facilitate the evaporation of moisture from the liner.

Similar disposable inserts or liners are disclosed in U.S. Pat. No. 2,445,209 and U.S. Pat. No. 1,957,356.

Although these and other examples are known in the prior art of disposable liners for head coverings, the need exists for an improved form of disposable liner which further facilitates the protective function of the liner by encouraging the transportation of contaminant containing moisture away from the hat or cap and which further embodies ease of manufacture and use.

SUMMARY OF THE INVENTION

In accordance with the present invention, a liner for a hat, cap or similar head covering comprises a layer of moisture absorbent material which is backed by a layer of moisture impervious material. Further, adhesive means are provided for releasably securing the liner to the sweatband of the hat, cap or similar headgear.

The moisture impervious layer of the present invention is typically a plastic material. The moisture absorbing layer is typically composed of fibers of moisture absorbing materials such as cellulose. In addition, the moisture absorbing layer may also include fibers of thermoplastic materials such as polyethylene and polypropylene.

In order to facilitate the protective purpose of the disposable liner, the bottom and side edges of the moisture absorbing layer are sealed to prevent the migration of moisture, oil, grease and other contaminants through these edges of the liner. By contrast, the upper edge of the liner is left unsealed so that a wicking action encourages the transport of moisture from the body of the moisture absorbing layer to the top edge where it may be evaporated. The heat generated by the user would contribute to the moisture evaporation process. Another, design, would be to seal only the short edges of the liner. This would facilitate some degree of flow through ventilation, but the pressure of the user's forehead could tend to retard or eliminate this effect.

The seals along the bottom and side edges of the liner may be accomplished by impregnating the edges with a moisture impervious plastic material. In the preferred embodiment of the present invention, the edge sealing is accomplished by heat fusing of the edges so that the plastic of the moisture impervious layer is impregnated into the fibers of the moisture absorbing layer along the bottom and side edges. In addition, if the moisture absorbing layer includes thermoplastic fibers the heat sealing of the edges may be further enhanced by the fusing of the thermoplastic fibers along the bottom and side edges.

One means to accomplish the heat fusing of the bottom and side edges is to employ ultrasonic cutting and welding machinery of a type which is well known in the art. For example, U.S. Pat. Nos. 5,061,331 and 4,693,771 disclose the use of ultrasonic machinery for cutting and sealing the edge of fibrous materials, including fibrous materials having thermoplastic fiber components. The top edge of the present invention may be shaped and cut by any means which do not involve the application of heat to the edge so that the moisture absorbing fibers remain open to the environment. Such cutting means are well known in the art and would include the use of knives and similar means.

It is thus an object of the present invention to provide for an improved disposable liner for headgear which facilitates the removal of moisture from the disposable liner.

It is a further object of the present invention to provide for an improved disposable liner for headgear which is efficiently and inexpensively manufactured.

Other objects and advantages of the present invention will become apparent from the following detailed description of the preferred embodiments with reference to the appended drawings.

DETAILED DESCRIPTION OF THE PREFERRED EMBODIMENTS

Figure 2:
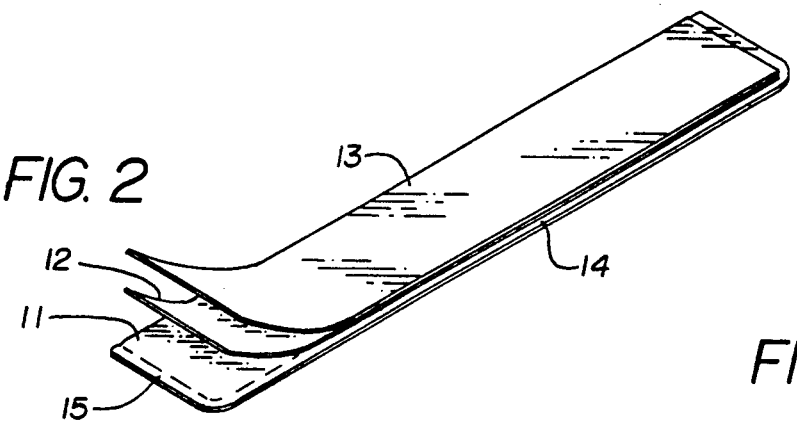
FIG. 2 is a partially exploded isometric view of the present invention.
Figure 3:
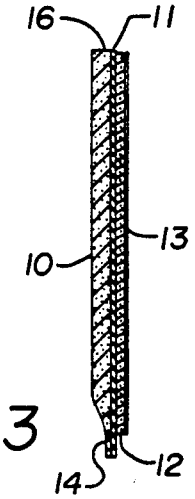
FIG. 3 is a sectional transverse view of the present invention.
Figure 4:
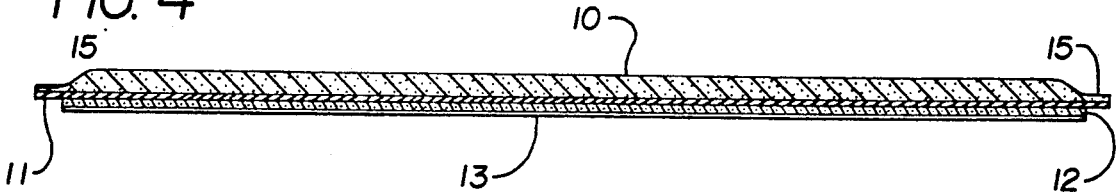
FIG. 4 is a sectional longitudinal view of the present invention.

With reference to FIGS. 2, 3 and 4, the present invention comprises a layer of moisture absorbing material 10, a layer of moisture impervious material 11, an adhesive layer 12 for releasably securing the present invention to the sweatband of a hat, cap or similar headgear and a protective release layer 13 which protects and covers the adhesive layer 12 until the present invention is placed into position on the sweatband of the hat, cap or similar headgear. The present invention is approximately 8 ½ inches in length. The precise length is not critical, but the length should be long enough to completely cover the areas of contact between the headgear and the head of the user.

The adhesive layer 12 may be a layer of adhesive material applied to the moisture impervious layer 11 or alternatively it may be a layer of double-sided tape which adheres directly to the moisture impervious layer 11. The particular means for accomplishing the adhesive function of the present invention are not significant to the scope of the present invention. Various means may be employed so long as the adhesive layer 12 is sufficiently adhesive to secure the present invention in place on the sweatband of the headgear and which further embodies the property of being removable so that the adhesive is not permanent. The protective release layer 13 is typically a form of coated paper which adheres lightly to the adhesive layer 12.

Figure 1:
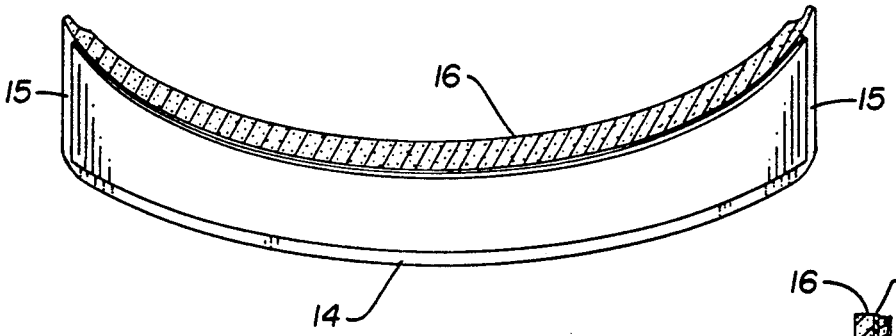
FIG. 1 is a perspective view of the front and top of the present invention.
Figure 5:
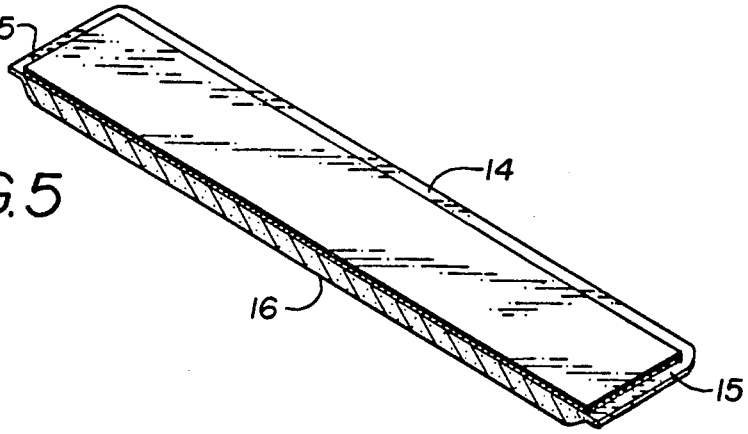
FIG. 5 is an isometric view of the back and top sides of the present invention.

With references to FIGS. 1 and 5, it may be seen that the preferred embodiment of the present invention comprises a bottom sealed edge 14 and a pair of side sealed edges 15. The top edge 16 is, however, left unsealed so that the moisture absorbing layer 10 is exposed along the top edge 16. In an alternative embodiment of the present invention, the bottom edge 14 may be left unsealed and would therefore be identical to the top edge 16. This alternative is thought to have some advantages in manufacturing and may have functional advantages by allowing a flow of air vertically through the moisture absorbing layer 10. The pressure of the wearer's head against the moisture absorbing layer 10 may, however, restrict the flow. Additionally, the advantage of the sealed bottom edge is lost; potentially allowing moisture and other contaminants to escape.

The moisture impervious layer 11 can be any type of thin, flexible, moisture impervious material. Typically the moisture impervious layer 11 would be comprised of a layer of thin, flexible plastic material.

The moisture absorbing layer 10 may be composed of moisture absorbing fibrous materials, for example, cotton batting. In addition, the moisture absorbing layer 10 may include a quantity of thermoplastic fibers such as polyethylene or polypropylene. An effective composition for the moisture absorbing layer 10 has been found to be a composition of approximately 50–60% cellulose fibers, 30–40% polypropylene fibers and approximately 10% polyethylene fibers. The cellulose fibers are typically cotton fibers.

Although various methods may be used to produce the sealed edges 14, 15, in the preferred embodiment the edges 14, 15 are heat fused so that the thermoplastic polyethylene and polypropylene fibers are melted and impregnated into the cellulose fibers. The thermoplastic fibers in the sealed edges 14, 15 will also fuse with the plastic material of the moisture impervious layer 11 so as to form a moisture impervious seal along the edges 14, 15. The preferred method for accomplishing the edge sealing is to employ ultrasonic cutting and edge sealing apparatus. The use of an ultrasonic apparatus allows the edges 14, 15 to be cut and sealed in a single operation. In order to leave the top edge 16 unsealed, it is necessary to employ cutting equipment which does not effect heat fusing of the plastic fibers in the moisture absorbent layer 10. Such cutting apparatus which would generally employ knives or sharp cutting edges are well known in the art.

Figure 6:
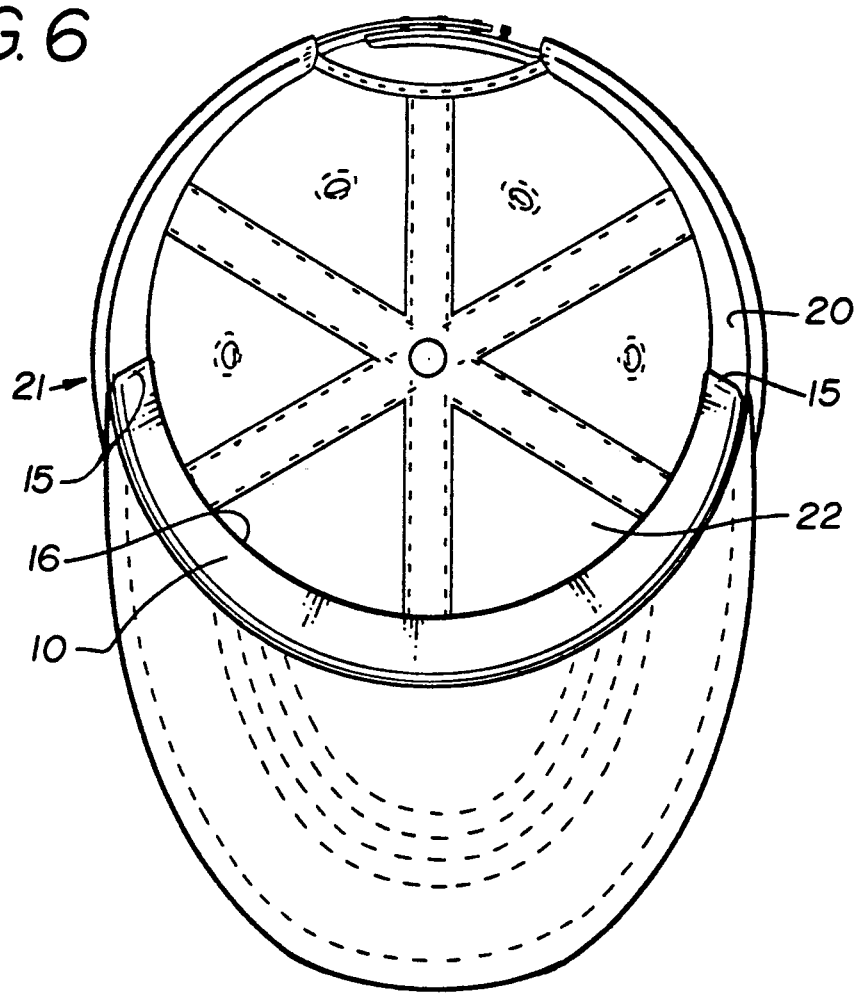
FIG. 6 is a plan view of the underside of a typical cap showing the present invention in place on the sweatband thereof.
Figure 7:
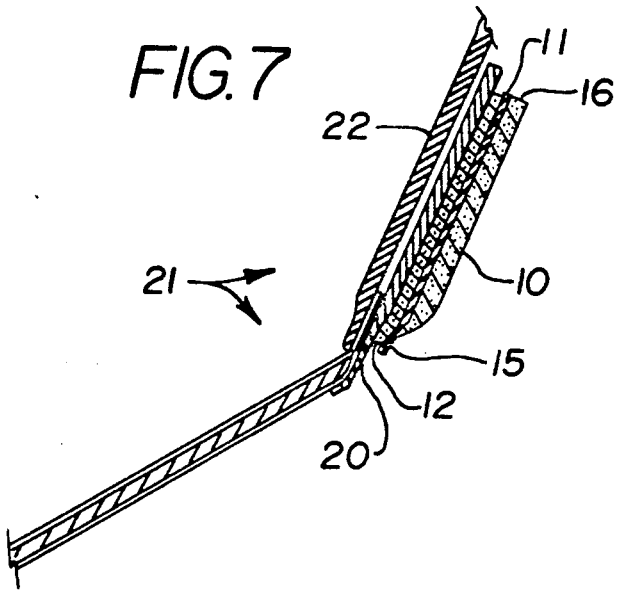
FIG. 7 is a partial section of the sweatband and bill of the cap of FIG. 6 showing the present invention in place.

With reference to FIGS. 6 and 7, the present invention would normally be employed by placing it on the front portion of the sweatband 20 of a hat, cap or similar headgear. FIG. 6 illustrates a typical type of headgear 21 known as a baseball cap or golf cap. The present invention is placed on the sweatband 20 such that the adhesive layer 12, after the protective release layer 13 is removed, is in contact with the sweatband 20. The moisture absorbent layer 10 is thus exposed to contact with the forehead of the wearer of the cap 21. FIG. 7 is a partial section through the sweatband 20. The present invention is placed so that the upper edge 16 of the moisture absorbent layer 10 is placed uppermost with respect to the cap 21. Perspiration from the user is therefore absorbed directly by the moisture absorbing layer 10. Due to the sealed edges 14, 15 and to the moisture impervious layer 11, the perspiration, oils and other contaminants cannot migrate directly into the sweatband 20 and from thence into the material 22 of the cap 21. Through a wicking action, the moisture is transported to the open top edge 16 of the moisture absorbing layer 10. From thence the moisture is evaporated away so there is no tendency to enter the sweatband 20 or the cap material 22.

Since the present invention is releasably secured to the sweatband 20, it may be removed and discarded at regular intervals so that any contamination remaining in the moisture absorbing layer 10 may be disposed of as necessary.

Although the present invention is described with respect to certain preferred embodiments, such descriptions are exemplary and not by way of limitation to the full scope of the present invention as set forth in the appended claims.

What is claimed is:

1. A liner for the sweatband of a hat, comprising:
   (a) a substantially rectangular body of moisture absorbing material having front and back surfaces, a pair of moisture impervious side edges and a pair of longitudinal edges, at least one of said longitudinal edges being moisture permeable;
   (b) a layer of moisture impervious material affixed to and covering said back side of said moisture absorbing body; and
   (c) adhesive means affixed to said layer of moisture impervious material for releasably securing the liner to the sweatband of the hat.

2. The liner of claim 1 wherein said body of moisture absorbing material consists essentially of cellulose fiber.

3. The liner of claim 1 wherein said body of moisture absorbing materials additionally comprises thermoplastic fibers.

4. The liner of claim 1 wherein said adhesive means comprises a layer of double-sided adhesive tape and a release layer of protective material over said adhesive tape.

5. The liner of claim 1 wherein said adhesive means comprises a layer of adhesive material covering at least a portion of said layer of moisture impervious material and a release layer of protective material over said layer of adhesive material.

6. A liner for the sweatband of a hat, comprising:

(a) a substantially rectangular body of moisture absorbing material consisting essentially of cellulose and thermoplastic fibers, said body having front and back surfaces, a pair of side edges and a pair of longitudinal edges;

(b) a layer of moisture impervious plastic material affixed to and covering said back surface of said moisture absorbing body;

(c) at least one of said longitudinal edges comprising an exposed surface of said moisture absorbing material;

(d) said side edges each comprising a moisture impervious surface of heat-fused cellulose fibers and thermoplastic fibers; and (e) adhesive means affixed to said layer of moisture material for releasably securing the liner to the sweatband of the hat.

7. The liner of claim 6 wherein said adhesive means comprises a layer of double-sided adhesive tape and a release layer of protective material over said adhesive tape.

8. The liner of claim 6 wherein said adhesive means comprises a layer of adhesive material covering at least a portion of said layer of moisture impervious material and a release layer of protective material over said layer of adhesive material.

* * * * *